US006195058B1

(12) United States Patent
Nakamura et al.

(10) Patent No.: US 6,195,058 B1
(45) Date of Patent: Feb. 27, 2001

(54) DIELECTRIC LENS, DIELECTRIC LENS ANTENNA INCLUDING THE SAME, AND WIRELESS DEVICE USING THE SAME

(75) Inventors: Fuminori Nakamura, Nagaokakyo; Hideaki Yamada, Ishikawa-ken; Hiroaki Tanaka, Osaka-fu, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/340,615

(22) Filed: Jun. 29, 1999

(30) Foreign Application Priority Data

Jun. 29, 1998 (JP) ..... 10-182525

(51) Int. Cl.[7] ..... H01Q 19/06
(52) U.S. Cl. ..... 343/753; 343/755
(58) Field of Search ..... 343/753, 758, 343/911 L, 911 R, 755, 909, 785, 700 MS

(56) References Cited

U.S. PATENT DOCUMENTS 4,307,403 * 12/1981 Yamada et al. ..... 343/755
4,825,221 * 4/1989 Suzuki et al. ..... 343/785
5,892,487 * 4/1999 Fujimoto ..... 343/840
5,900,847 * 5/1999 Ishikawa et al. ..... 343/909
6,034,642 * 3/2000 Kojima et al. ..... 343/753
6,052,087 * 4/2000 Ishikawa et al. ..... 343/700

FOREIGN PATENT DOCUMENTS 3840451 6/1990 (DE) .
19645816 5/1998 (DE) .
2423876 11/1979 (FR) .
2029114 8/1979 (GB) .
9815033 4/1998 (WO) .

* cited by examiner

*Primary Examiner*—Don Wong
*Assistant Examiner*—Chuc D Tran
(74) *Attorney, Agent, or Firm*—Ostrolenk, Faber, Gerb & Soffen, LLP

(57) ABSTRACT

The invention provides a dielectric lens, wherein the dielectric lens is rotation-symmetrically shaped, and a flat end is disposed at a part of the edge the dielectric lens. By the above described structure and arrangement, it become possible to widen a half-value angle in the direction which the flat ends of the lens are disposed without reducing a gain significantly.

10 Claims, 11 Drawing Sheets

DIELECTRIC LENS, DIELECTRIC LENS ANTENNA INCLUDING THE SAME, AND WIRELESS DEVICE USING THE SAME

BACKGROUND OF THE INVENTION

1. Field of the Invention

The present invention relates to a dielectric lens, a dielectric lens antenna including the same, and a wireless device including the same. More specifically, the present invention relates to a dielectric lens applied for a motor-vehicle-mounted radar which uses millimeter-waves, a dielectric lens antenna including the same, and a wireless device including the same.

2. Description of the Related Art

With the recent advance of motor-vehicle-mounted radar, control of the directivity of an antenna has been a significant concern.

FIGS. 11A, 11B and 11C show a prior art dielectric lens. FIG. 11A is a plan view, FIG. 11B is a front view, and FIG. 11C is a side view. In a dielectric lens 1, a lens 2 is substantially in a shape formed by cutting a part of a sphere. In the plan view, it is formed rotation-symmetrically, namely, in a round form, and in the front view and the side view, it is formed in a circular form. The lens 2 is made of dielectric materials such as ceramics, resin, plastic, or their composite materials. The focal direction of the dielectric lens 1 is the -z-axis direction.

FIGS. 12A, 12B and 12C show a dielectric lens antenna including the dielectric lens 1 shown in FIG. 11A, 11B and 11C. FIG. 12A is a plan view; FIG. 12B is a front view; and FIG. 12C is a side view. In FIG. 12, the dielectric lens antenna 5 is formed by disposing a primary radiator 7 at the focal point 6 of the dielectric lens 1.

FIG. 13 shows a conceptual view (a front view) illustrating the directivity of a beam radiated from the dielectric lens 1 of the dielectric lens antenna 5 shown in FIGS. 12A, 12B and 12C. In FIG. 13, the same reference numerals are given to the same parts as those in FIG. 12 or the equivalent parts to those in FIG. 12; their descriptions are omitted. As shown in FIG. 13, the shape of beam 3 radiated from the dielectric lens 1 of the dielectric lens antenna 5 is a pencil-beam shape on the x-z side. In this case, the length (the height in FIG. 13) of z-axis direction of the beam 3 indicates the magnitude of a gain of the dielectric lens antenna 5, and the width of the beam 3 indicates the magnitude of the beam width of the dielectric lens antenna 5.

As seen above, the gain of the dielectric lens antenna 5 amounts to a maximum value in the z-axis direction. With respect to the z-axis direction, the angle in which a gain decreases by 3 dB from the maximum value, namely, the angle in which the gain amounts to a half is referred to a half-value angle, which indicates the directivity of the antenna. The shape of the beam 3 radiated from the dielectric lens 1 of the dielectric lens antenna 5 is the same on all the sides which include the z-axis and parallel to the z-axis, such as the x-y side, so that the line connecting points of the half-value angles forms a round form when viewed from the front of the dielectric lens antenna 5. In addition, the half-value angle is substantially indicated by a formula:

$$\text{A half-value angle } (\theta)=70\lambda/D$$

($\lambda$: wavelength of the used frequency,

D: antenna-aperture diameter)

Thus, a half-value angle is inversely proportional to an antenna aperture diameter. In contrast, the wider the aperture diameter, the larger the gain.

A motor-vehicle-mounted radar does not necessarily require the information of a vertical direction (up-and-down directions) with respect to a traveling direction of a motor vehicle. On the contrary, in order to prevent malfunctions due to reactions with a pedestrian overpass or a viaduct, it may be better for the radar to have less information of a vertical direction. Meanwhile, the information of a horizontal direction (a traveling direction and right-and-left directions of a motor vehicle) is primarily necessary, since other motor vehicles and obstacles are targeted. This can require a wide-angle antenna, in which a beam is narrowed in the vertical direction, whereas it is widened in the horizontal direction. In this case, in order to widen the beam, namely, to widen the half-value angle, it is necessary to make the antenna-aperture diameter smaller, namely, it is necessary to reduce the diameter of the dielectric lens. However, reducing the diameter of the dielectric lens leads to decrease in gain, thereby it creates a problem in which the lens can only detect at close range when it is used in radar. In addition, reducing the diameter of the dielectric lens leads to extension of the beam not only in the horizontal direction but also in the vertical direction; it thereby leads to further decrease in the gain in the horizontal direction.

SUMMARY OF THE INVENTION

To overcome the above problems, preferred embodiments of the present invention provide a dielectric lens capable of widening a half-value angle in a specified direction without decreasing a gain significantly, a dielectric lens antenna including the same, and a wireless device including the same.

One preferred embodiment of the present invention provides a dielectric lens and a dielectric lens antenna including the dielectric lens, wherein the dielectric lens is rotation-symmetrically shaped, and a flat end is disposed at a part of the edge the dielectric lens. In the dielectric lens antenna, a primary radiator is disposed at the focal point of the dielectric lens.

By the above described structure and arrangement, it become possible to widen a half-value angle in the direction in which the flat ends of the lens are disposed without reducing a gain significantly.

Preferably, in the above described dielectric lens, a first flat end and a second flat end are respectively disposed at a part of the edge the dielectric lens and opposed to each other. This structure and arrangement allows the half-value angles of the dielectric lens and the dielectric lens antenna to be smaller in the vertical direction (horizontal direction) and to be greater in the horizontal direction (vertical direction).

In the above described dielectric lens antenna, the primary radiator and the dielectric lens may be connected by a supporting plate extending in a taper shape from the outer periphery of the primary radiator to the edge of the dielectric lens over the entire circumference; and at least inner surface of the supporting plate may be made of metal.

By the above described structure and arrangement, spill-over losses can be reduced to thereby high efficiency is achieved.

Another preferred embodiment of the present invention provides a wireless device comprising the above described dielectric lens antenna.

Use of the dielectric lens antenna of the present invention can control extension of a beam to reduce malfunctions of a wireless device.

Other features and advantages of the present invention will become apparent from the following description of preferred embodiments of the invention which refers to the accompanying drawings, wherein like reference numerals indicate like elements to avoid duplicative description.

BRIEF DESCRIPTION OF DRAWINGS

FIGS. 1A, 1B and 1C show one preferred embodiment of a dielectric lens according to the present invention, in which FIG. 1A is a plan view; FIG. 1B is a front view; and FIG. 1C is a side view.

FIGS. 2A, 2B and 2C show another preferred embodiment of a dielectric lens antenna according to the present invention, in which FIG. 2A is a plan view; FIG. 2B is a front view; and FIG. 2C is a side view.

FIGS. 3A and 3B show a conceptual view illustrating the directivity of a beam radiated from the dielectric lens of a dielectric lens antenna shown in FIGS. 2A, 2B and 2C, in which FIG. 3A is a front view; and FIG. 3B is a side view.

FIGS. 8A, 8B and 8C show yet another preferred embodiment of the dielectric lens according to the present invention, in which FIG. 8A is a plan view; FIG. 8B is a front view; and FIG. 8C is a side view.

FIGS. 9A, 9B and 9C show yet another preferred embodiment of the dielectric lens antenna according to the present invention, in which FIG. 9A is a plan view; FIG. 9B is a front view; and FIG. 9C is a side view.

FIGS. 11A, 11B and 11C show a view of a prior art dielectric lens, in which FIG. 11A is a plan view; FIG. 11B is a front view; and FIG. 11C is a side view.

FIGS. 12A, 12B and 12C show a view of a prior art dielectric lens, in which FIG. 12A is a plan view; FIG. 12B is a front view; and FIG. 12C is a side view.

DESCRIPTION OF THE PREFERRED EMBODIMENTS

Figure 1A:
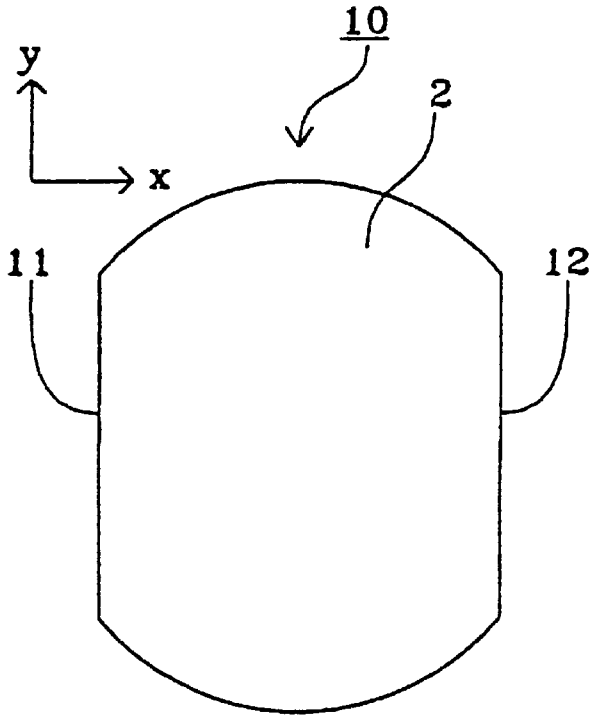
Figure 1B:
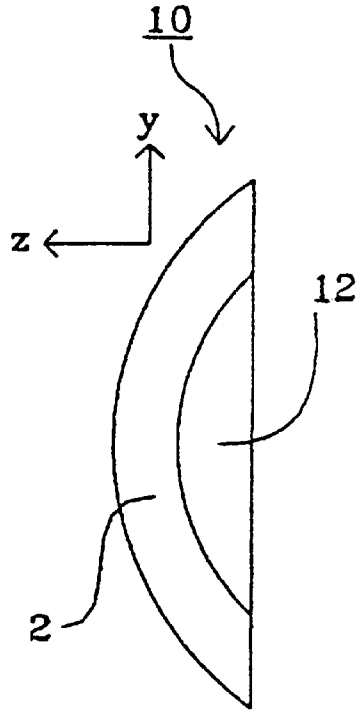
Figure 1C:
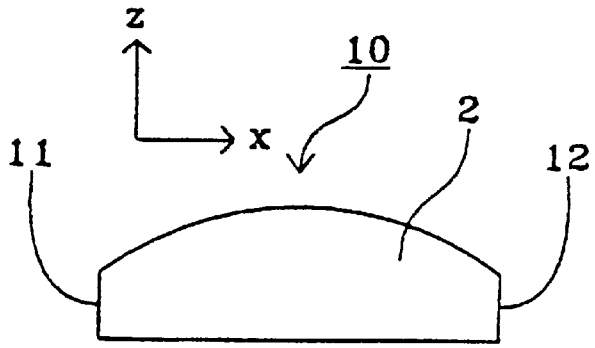
Figure 11A:
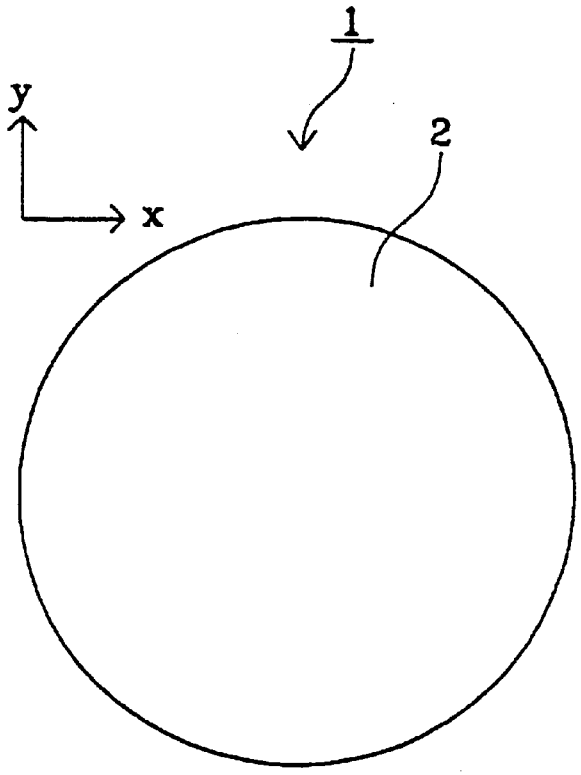
FIG. 11A PRIOR ART
Figure 11B:
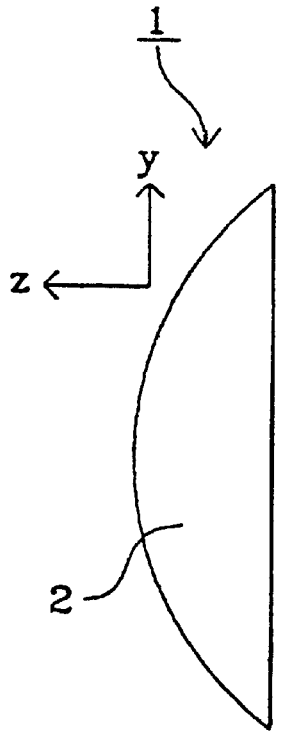
FIG. 11B PRIOR ART
Figure 11C:
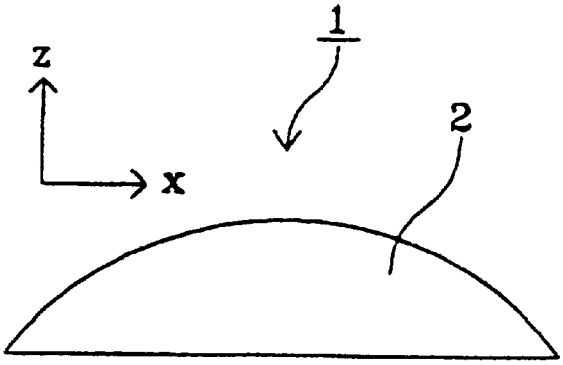
FIG. 11C PRIOR ART
Figure 12A:
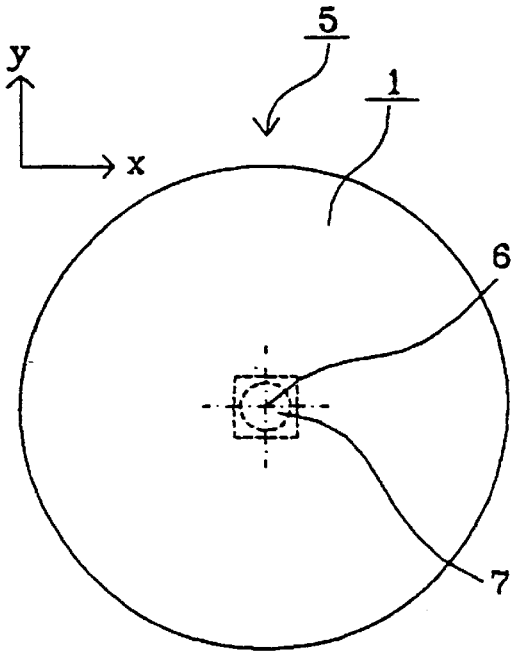
FIG. 12A PRIOR ART
Figure 12B:
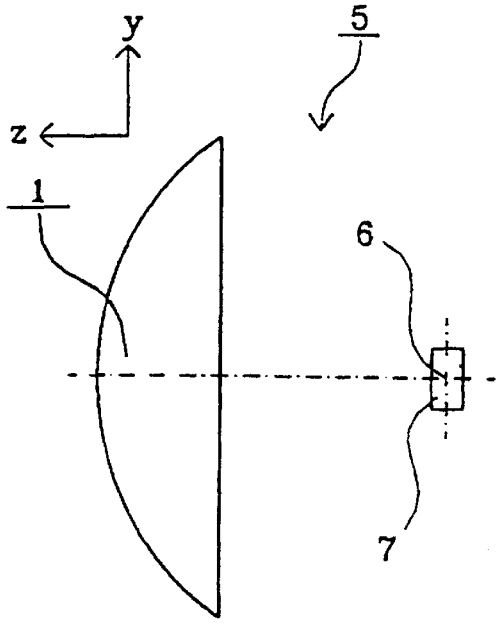
FIG. 12B PRIOR ART
Figure 12C:
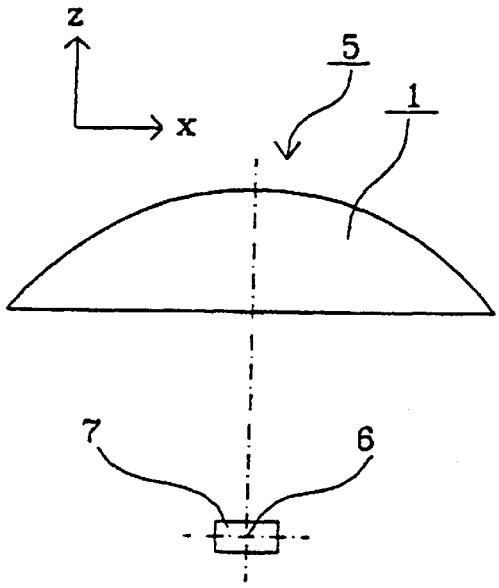
FIG. 12C PRIOR ART

Regarding a dielectric lens 10 shown in FIGS. 1A, 1B and 1C, when compared to a prior art dielectric lens shown in FIG. 11A, the left edge of the lens 2 is linearly cut away from the rotation-symmetrical form, namely, the round form so as to make a flat first end 11, whereas the right edge of the same is linearly cut away so as to make a flat second end 12. The first end 11 and the second end 12 are opposed to each other.

In terms of the formation of the first end 11 and the second end 12, for the sake of convenience, a description has been provided that they are formed by cutting away the edge of the lens 2. In addition, even in the hereinafter description, the expression of cutting away the edge of the lens will be used for the convenience. However, when the lens is actually formed, the forming method is not limited to the one in which the ends are formed by cutting away the edge after forming the lens rotation-symmetrically. It may be possible to form the lens in a shape having an end from the beginning.

Figure 2A:
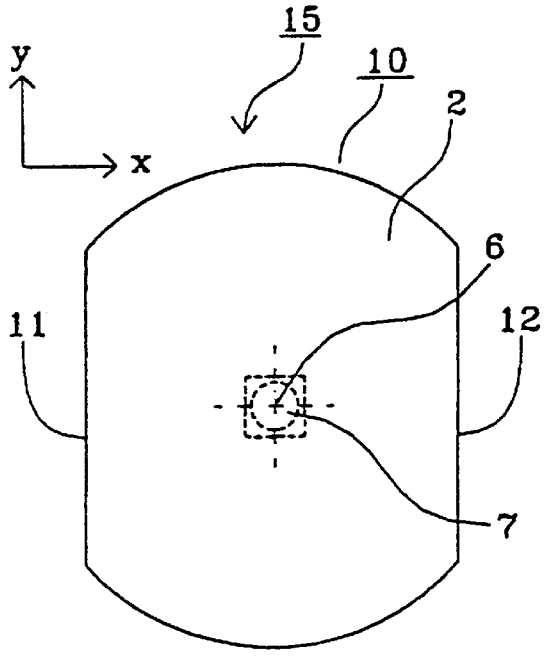
Figure 2B:
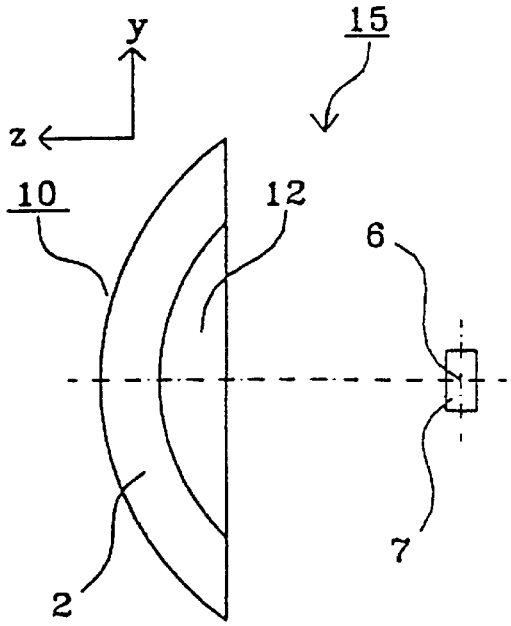
Figure 2C:
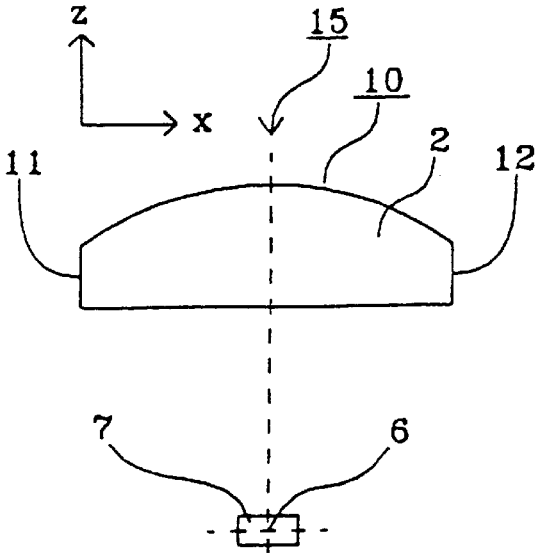

Referring to FIGS. 2A, 2B and 2C, the dielectric lens antenna 15 is formed by disposing a primary radiator 7 in the focal point 6 of the dielectric lens 10.

Figure 3A:
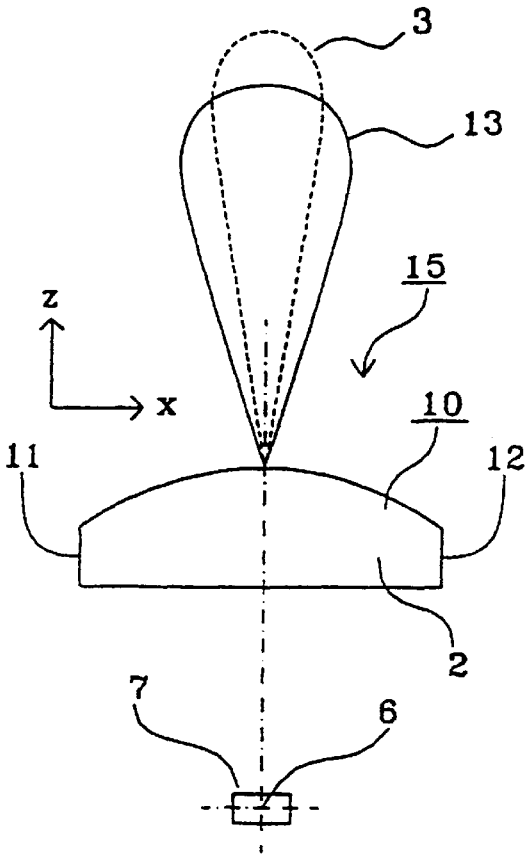
Figure 3B:
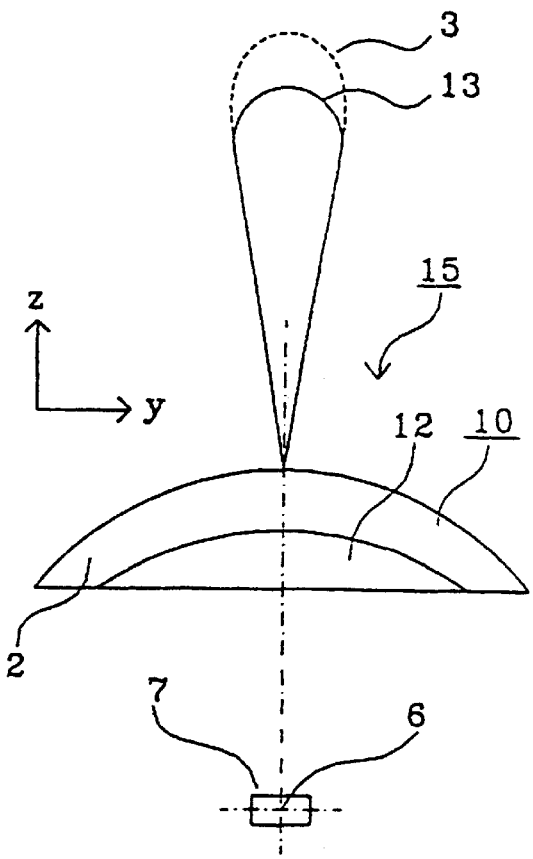
Figure 13:
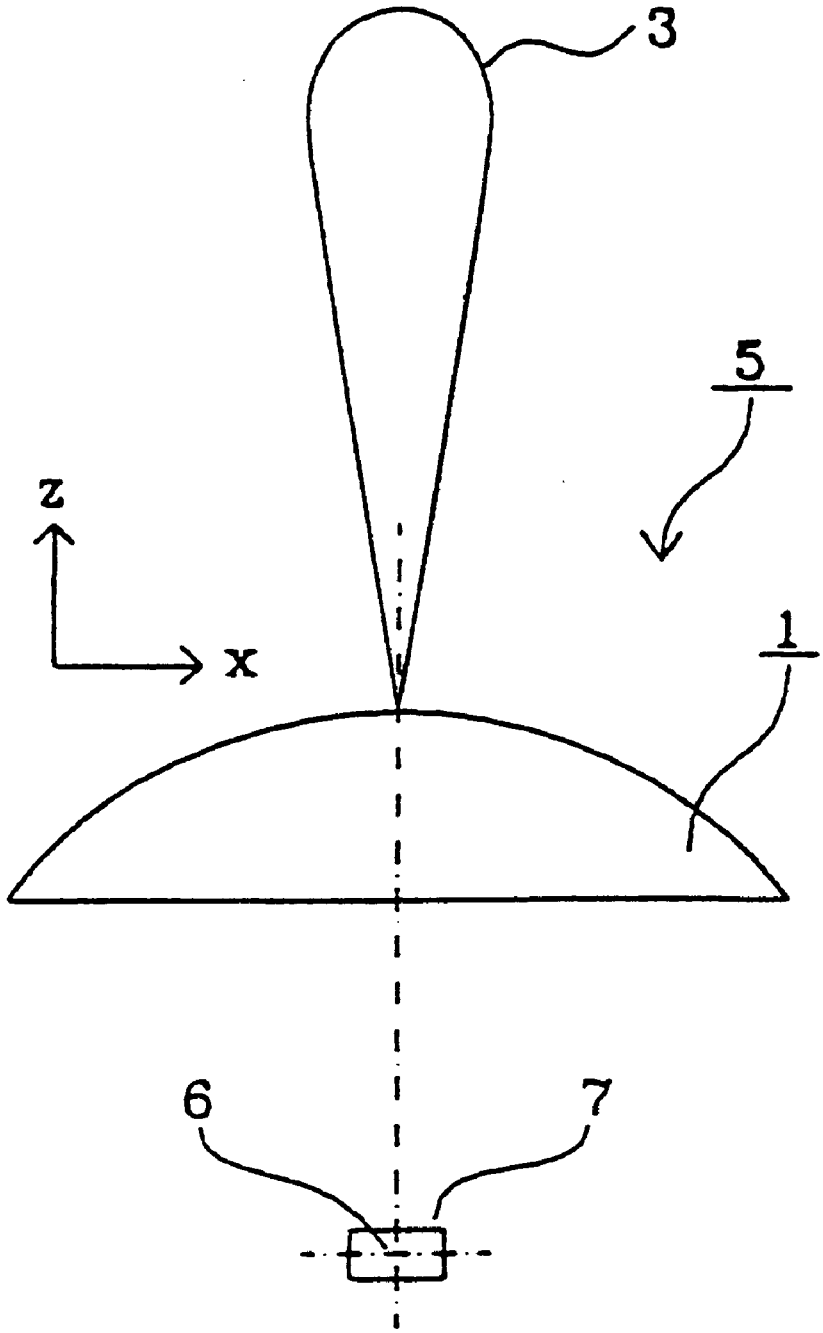
FIG. 13 PRIOR ART
FIG. 13 shows a conceptual view (a front view) illustrating the directivity of a beam radiated from the dielectric lens of the dielectric lens antenna shown in FIGS. 12A, 12B and 12C.

FIGS. 3A, 3B and 3C show a conceptual view illustrating the directivity of a beam 13 radiated from the dielectric lens 10 of the dielectric lens antenna 15 shown in FIG. 2. For comparison, the shape of the beam 3 radiated from the conventional dielectric lens antenna 5 shown in FIG. 13 is indicated by dashed lines.

As shown in FIG. 3A, the shape of the beam 13 radiated from the dielectric lens 10 of the dielectric lens antenna 15, when compared to the shape of the conventional beam 3, extends in the x-axis direction, namely, in a direction in which the first end 11 and the second end 12 are formed by cutting away the edge of the lens 2; thereby, a half-value angle widens. In contrast, the maximum gain becomes a little smaller than that of the conventional art, since the aperture area is reduced due to cutting-away of the edge of the lens. Meanwhile, as shown in FIG. 3B, in the y-axis direction, namely, in the direction in which the edge of the lens is not cut away, the shape of the beam 13 is substantially the same as that of the conventional one, although the maximum gain is smaller; and the half-value angle is almost the same.

Figure 4:
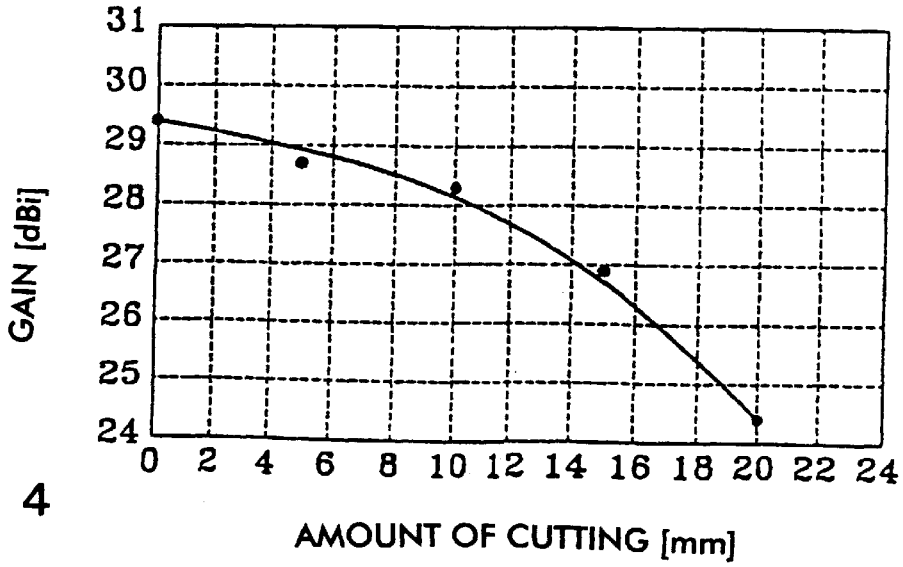
FIG. 4 shows a relationship between the amount of cut-away parts of the lens and gains of the dielectric lens antenna according to the present invention.
Figure 5:
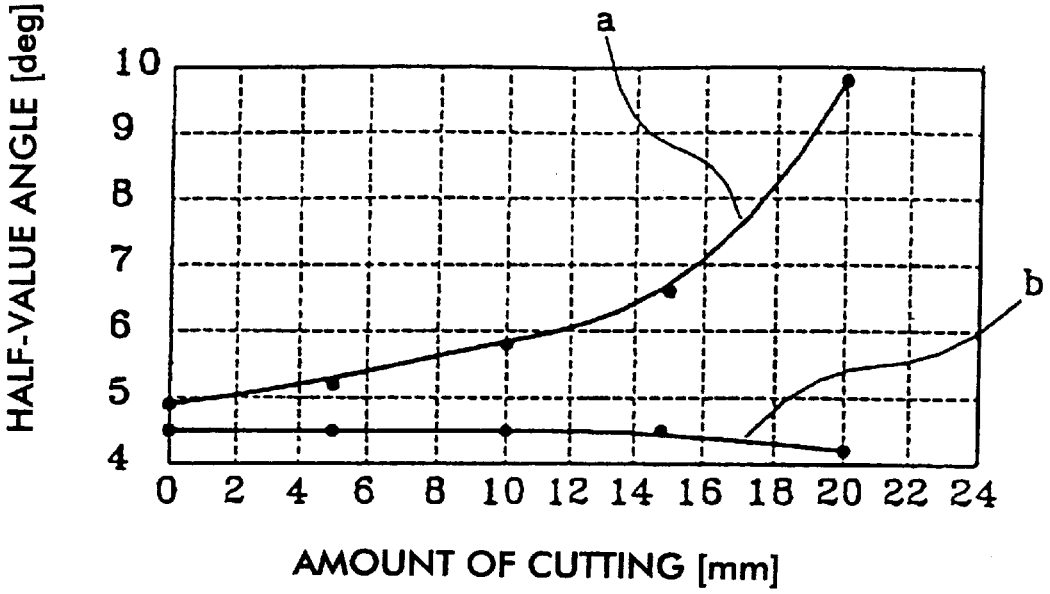
FIG. 5 shows a relationship between the amount of cut-away parts of the lens and half-value angles of the dielectric lens antenna according to the present invention.

FIGS. 4 and 5 respectively show the relationship between the amount of cut-away parts of the lens 2 and the antenna-gain, and the relationship between the amount of cut-away parts of the lens 2 and the half-value angle, respectively, in terms of the dielectric lens 10 used in the dielectric lens antenna 15 according to the present invention. In this case, the diameter of the lens 2 is 73 mm. In FIG. 5, a shows a half-value angle on the x-z side and b shows a half-value angle on the y-z side.

As shown in FIG. 4, the larger the amount of cut-away parts of the lens 2, the smaller the aperture area of the dielectric lens 10; thereby the gain tends to be smaller, too. In addition, as shown in FIG. 5, the larger the amount of cut-away parts of the lens 2, the exponentially wider the half-value angle a on the y-z side, namely, in the cut-away direction. The half-value angle b on the y-z side is not influenced by the amount of cut-away parts of the lens 2.

In this way, in the dielectric lens 10, it is to be understood that formation of the first end 11 and the second end 12 by cutting away mutually opposing two places of the edge of the lens 2 permits extension of a beam only in the direction in which the edge has been cut away. Furthermore, the dielectric lens antenna 15 is formed by using the dielectric lens 10 in such a manner that the x-axis direction is used as the horizontal direction and the y-axis direction is used as the vertical direction in FIGS. 2A, 2B and 2C. This permits formation of an antenna in which the beam does not extend in the horizontal direction, whereas it hardly extends in the vertical direction.

The above-described dielectric lens antenna extending a beam in the horizontal direction is effective to a radar of mono-pulse system (a radar for measuring a distance and an angle with respect to a target by emitting a one-time-pulse signal in a wide range to receive a reflected signal by two or more antennas disposed mutually having a distance therebetween). However, it is more convenient for a radar of beam-scan system (a radar for measuring an angle with respect to a target by performing an action of measuring a distance to the target from a reflected signal by emitting a signal in a narrow range, while sequentially changing the angle of the antenna in the horizontal direction) to make a beam in the horizontal direction narrower. Thus, in such a case, the vertical and horizontal directions in a plan view of the dielectric lens antenna shown in FIGS. 2A, 2B and 2C are inverted to use the x-axis direction vertically and the y-axis direction horizontally. This makes the beam toward the horizontal direction narrower; thereby malfunctions with respect to the angle of a target in beam-scanning can be reduced.

Figure 6:
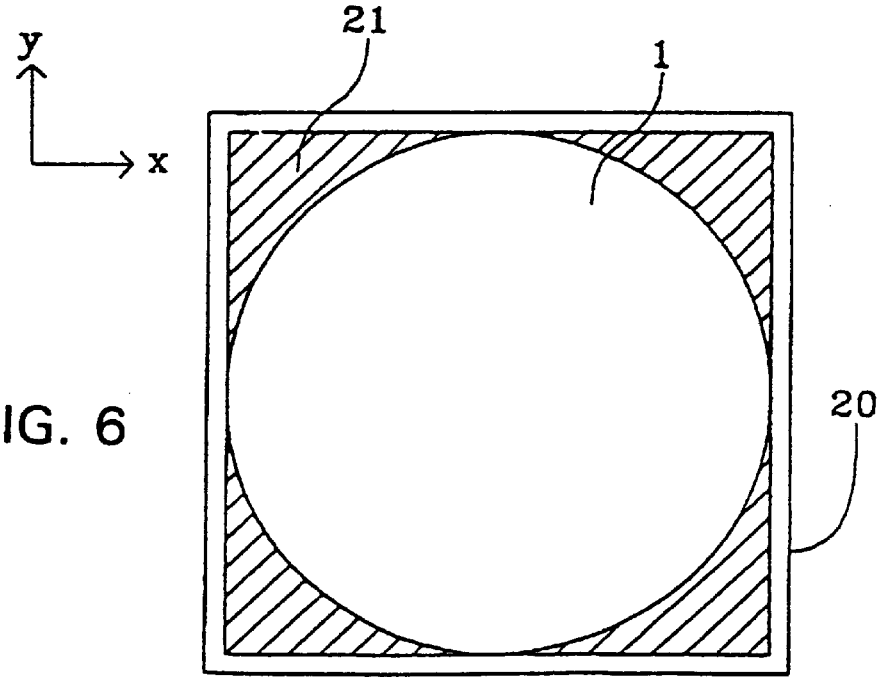
FIG. 6 shows a plan view of the dead space in a state in which a conventional dielectric lens antenna is attached to a rectangular frame.

Generally, a dielectric lens is often attached to a rectangular frame. FIG. 6 shows a plan view of a prior art round dielectric lens 1, which is attached to a rectangular frame 20. As seen in FIG. 6, attaching the round dielectric lens 1 to the rectangular frame 20 allows a dead space 21 (a region which does not serve as the aperture face of the dielectric lens) to be produced between the frame 20 and the dielectric lens 1 when view from the front. In this case, the area of the dead space 21 with respect to the frame 20 is approximately 21.5%.

Figure 7:
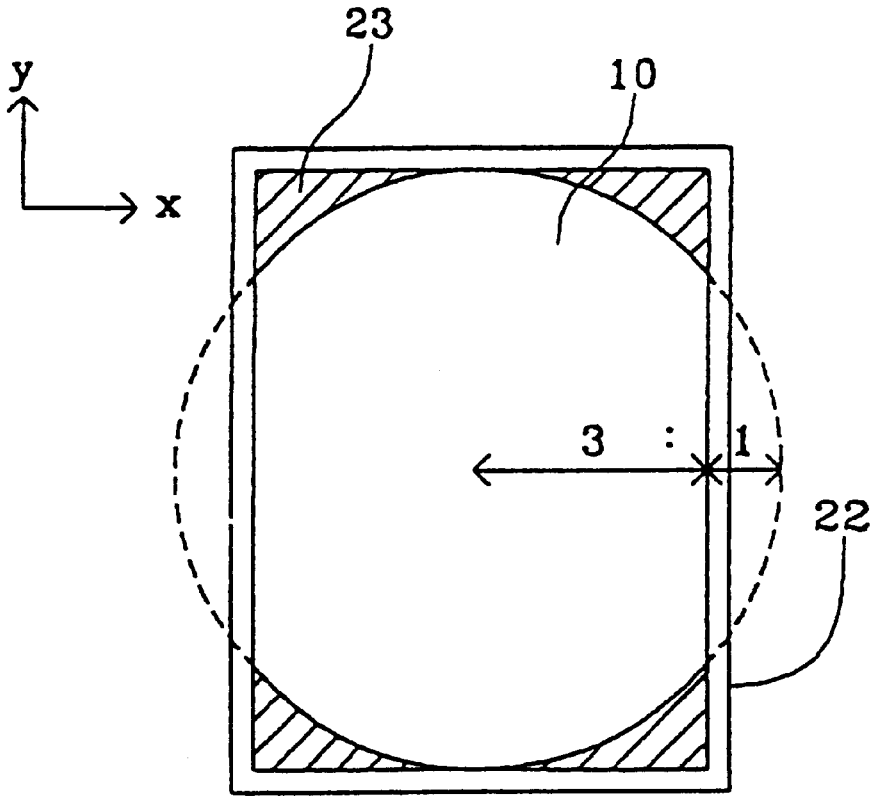
FIG. 7 shows a plan view of the dead space in a state in which the dielectric lens antenna of the present invention is attached to a rectangular frame.

Meanwhile, FIG. 7 shows a plan view of the dielectric lens 10 of the present invention, which is attached to a rectangular frame 22. As seen in FIG. 7, the dielectric lens 10 originally has a rectangle shape substantially when viewed in the plan view, since the mutually opposing two places of the edge of the lens 2 are cut away to form the first end and the second end. When the dielectric lens 10 is attached to the rectangular frame 22, the dead space 23 between the frame 22 and the dielectric lens 10 can be formed to be smaller than the prior art dielectric lens 1 shown in FIG. 6. For example, if the mutually opposing two places of the edge of the lens 2 are cut away at the position of ¼ of the radius, respectively, to form the first end and the second end, the frame 22 becomes a rectangle having two sides in the proportion of 3-to-4, and the area of the dead space 23 with respect to the frame 22 is approximately 10.4%, so that the area can be significantly smaller than that of the conventional art.

Furthermore, in a motor-vehicle-mounted radar, a dielectric lens antenna is mounted on the front of the vehicle, with the z-axis direction being oriented toward the direction in which the vehicle travels. In this case, since the dead space of the dielectric lens antenna is vertical to the traveling direction, air resistance increases and snow is likely to easily accumulate thereon. In this point, according to the dielectric lens antenna 10 of the present invention, the smaller the area of the dead space, the smaller the air resistance and the less the accumulation of snow, so that degradation of antenna characteristics can be reduced.

Figure 8A:
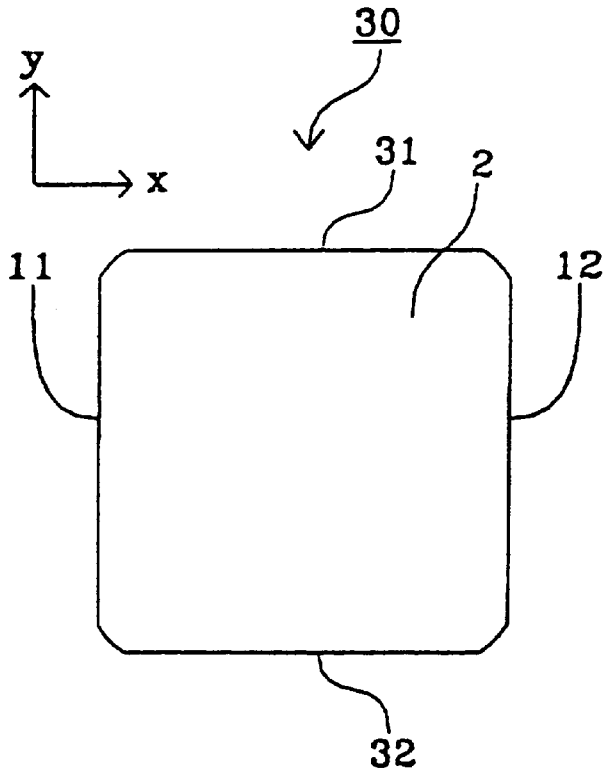
Figure 8B:
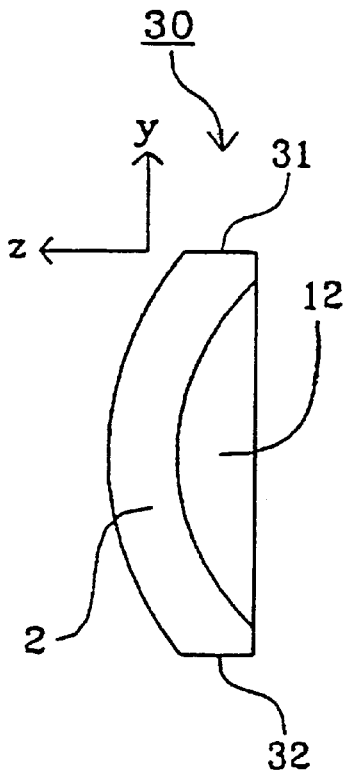
Figure 8C:
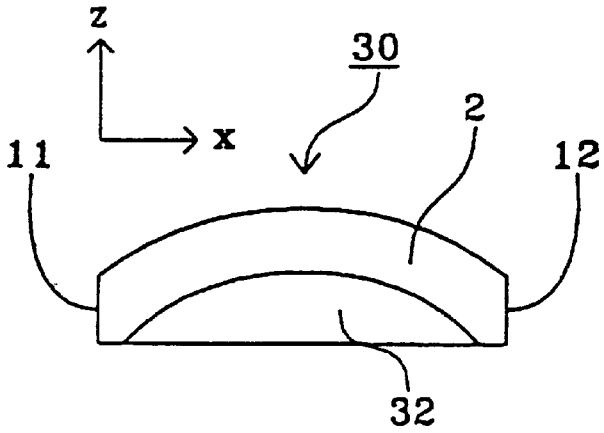

Referring to FIGS. 8A, 8B and 8C, in the dielectric lens 30, a third end 31, in which the edge of the upper side of the lens 2 is linearly cut away to be flat, is formed, in addition to the first end 11 and the second end 12 formed on the dielectric lens 10. Whereas a fourth end 32, in which the edge of the lower side is linearly cut away to be flat, is formed. In other words, four places of the edge of the lens 2 are cut away to form flat ends, respectively, so that the lens 2 is formed to be a shape close to a square when viewed in the plan view.

Such an arrangement permits the shape of a beam of the dielectric lens antenna using the dielectric lens 30 to be extended both in the horizontal direction and in the vertical direction. As a result, it is impossible to change the shape of a beam in the vertical direction and the horizontal direction as in the case of the dielectric lens antenna 15 shown in FIG. 2. However, although it is not shown here, it is clear that the dead space with respect to the rectangular frame is greatly smaller than that in the case where the diameter of the lens 2 is simply reduced. Accordingly, this can control both the reduction of the aperture area due to the miniaturization of the dielectric lens and the gain reduction so as to make both of them relatively small.

In contrast, when the diameter of the lens 2 of the dielectric lens 30 is extended to be as long as a diagonal line of the frame 20 shown in FIG. 6, and then the four places of the edge are cut away so as to be contained in the frame 20, the dead space is smaller than that of the dielectric lens 1 shown in FIG. 6, (namely, the aperture area is larger), so that a dielectric lens and a dielectric lens antenna having the same aperture diameter (namely, the same half-value angle) and yet offering a larger gain can be obtained.

Figure 9A:
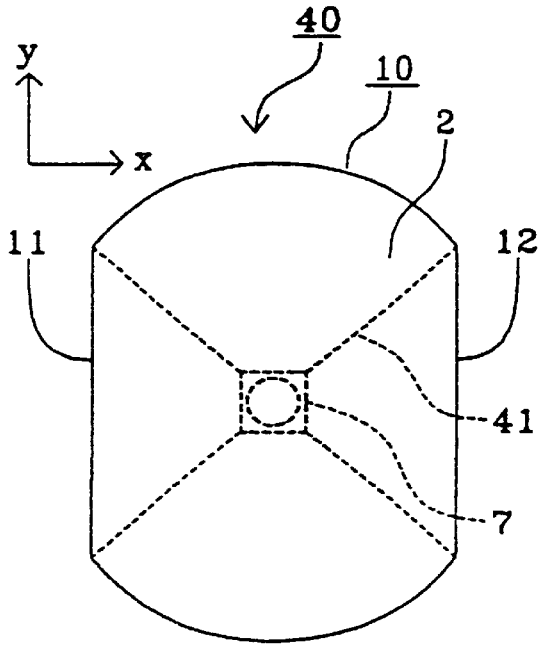
Figure 9B:
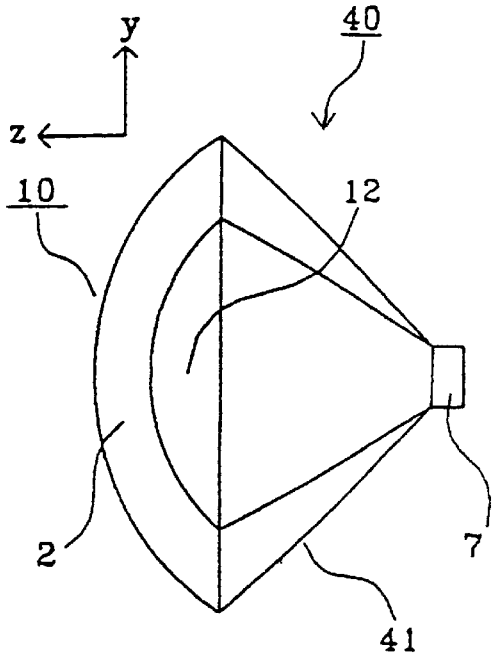
Figure 9C:
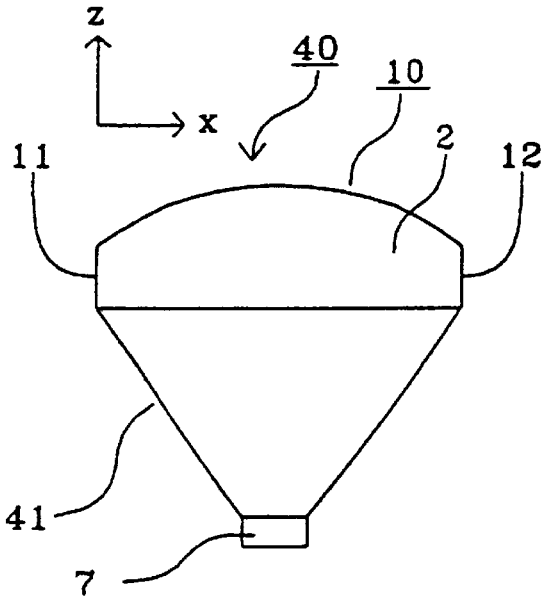

Referring to FIGS. 9A, 9B and 9C, the dielectric lens antenna 40 is formed in such a manner that the primary radiator 7 and the dielectric lens 10 in the dielectric lens antenna 15 shown in FIGS. 2A, 2B and 2C are connected by a supporting plate 41 extending in a taper shape over the entire circumference from the outer periphery of the primary radiator 7 to the edge of the dielectric lens 10. In this case, the inner surface of the supporting plate 41 is covered with metal coating to reflect electromagnetic waves.

Forming the dielectric lens antenna 40 in this way can reduce losses (spillover losses) due to electromagnetic waves leaking before reaching the dielectric lens 10 from the primary radiator 7, which are the losses increased due to formation of flat ends by cutting away the edge of the lens 2. Reduction of spillover losses leads to achievement of high efficiency, so that miniaturization of the aperture area of the dielectric lens, namely, miniaturization of the dielectric lens antenna can be achieved. Furthermore, retaining of the primary radiator 7 and the dielectric lens 10 by the supporting plate 41 permits the positional relationship between the primary radiator 7 and the dielectric lens 10 to be stable so as to reduce changes in the antenna characteristics with respect to vibrations or shocks, for instance, a positional deviation of the primary radiator 7 with respect to the focal point of the dielectric lens 10.

Although the dielectric lens antenna 40 shown in FIGS. 9A, 9B and 9C adopts a supporting plate whose inner surface is coated with metal, it is possible to obtain similar advantages by sticking a metal plate onto the inner surface or by using a supporting plate whose entire part is made of metal.

In addition, in the above embodiments, the two or four places of the edge of the lens are cut away to form flat ends. However, it may be possible to adopt an arrangement in which one, three, five or more places of the edge are cut away to form flat ends so as to obtain similar advantages.

Figure 10:
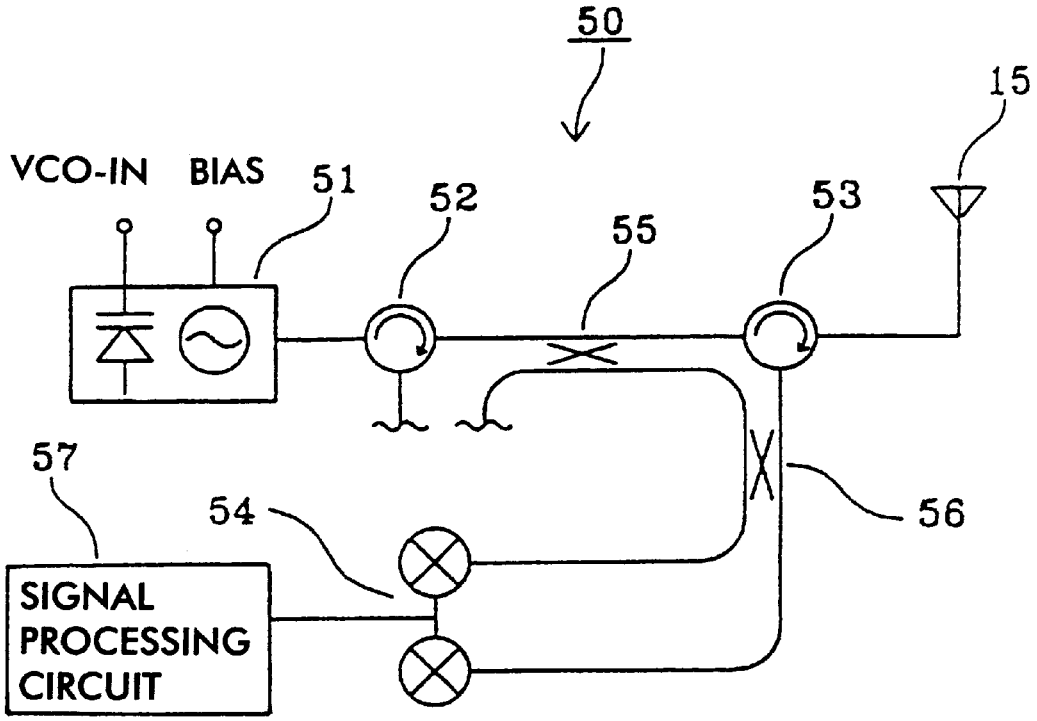
FIG. 10 shows a block diagram of a preferred embodiment of a wireless device according to the present invention.

As a preferred embodiment of a wireless device according to the present invention, FIG. 10 shows a block diagram of a motor-vehicle-mounted millimeter-wave radar. In FIG. 10, a millimeter-wave radar 50 is composed of the dielectric lens antenna 15 shown in FIGS. 2A, 2B and 2C, an oscillator 51, circulators 52 and 53, a mixer 54, couplers 55 and 56, and a signal-processing circuit 57.

In the millimeter-wave radar 50 having such an arrangement, the oscillator 51 uses Gunn diode as an oscillation device and uses varactor diode as an oscillation-frequency control device to form a voltage-controlled oscillator. Bias voltage for Gunn diode and frequency-modulation control voltage VCO-IN are input to the oscillator 51; and a transmission signal as the output is input to the coupler 55 through the circulator 52 so as not to return a reflection signal. The coupler 55 divides the transmission signal into two to emit one of them from the dielectric lens antenna 15 through the circulator 53 and inputs the other one as a local signal to the circulator 56. Meanwhile, the signal received by the dielectric lens antenna 15 is input to the coupler 56 through the circulator 53. The coupler 56 acts as a 3 dB-directional coupler to divide the local signal sent from the coupler 55 into equal parts with a phase difference of 90 degrees so as to input two mixer circuits of the mixer 54, whereas the coupler also divides the received signal sent from the circulator 53 into equal parts with a phase difference of 90 degrees so as to input to the two mixer circuits of the mixer 54. The mixer 54 performs balance-mixing of the two signals in which the local signal and the received signal are mixed and outputs the frequency-difference component of the local signal and the received signal as an IF signal so as to input to the signal processing circuit 57.

The above millimeter-wave radar 50 can obtain distance information and relative velocity information from the IF signal with the signal-processing circuit 57, for example, by providing a triangular wave information as the above VCO-IN signal. Accordingly, when this is mounted in a motor vehicle, the relative distance and the relative velocity with respect to other vehicles can be measured. Moreover, use of the dielectric lens antenna according to the present invention permits reduction of malfunctions by extending or narrowing a beam in a specified direction.

While the invention has been particularly shown and described with reference to preferred embodiments thereof, it will be understood by those skilled in the art that the forgoing and other changes in form and details may be made therein without departing from the spirit of the invention.

What is claimed is:

1. A dielectric lens comprising a rotation-symmetrically shaped body having a perimeter edge portion; and at least one flat part disposed at a part only of the perimeter edge portion.

2. The dielectric lens according to claim 1, wherein a first flat part and a second flat part are respectively disposed at a part of the perimeter edge portion of the dielectric lens and opposed to each other.

3. The dielectric lens antenna comprising a dielectric lens having a rotation-symmetrically shaped body having a perimeter edge portion and at least one flat part disposed at a part only of the perimeter edge portion and a primary radiator disposed at a focal point of the dielectric lens.

4. A dielectric lens antenna comprising a dielectric lens having a rotation-symmetrically shaped body having a perimeter edge portion and wherein a first flat part and a second flat part are respectively disposed at a part of the perimeter edge portion of the dielectric lens and opposed to each other, and further comprising a primary radiator disposed at a focal point of the dielectric lens.

5. The dielectric lens antenna according to claim 3, wherein the primary radiator and the dielectric lens are connected by a supporting plate extending in a taper shape for the outer periphery of the primary radiator to the edge portion of the dielectric lens over the entire circumference; and at least an inner surface of the supporting plate is made of metal.

6. The dielectric lens antenna according to claim 5, wherein the primary radiator and the dielectric lens are connected by a supporting plate extending in a taper shape from the outer periphery of the primary radiator to the edge portion of the dielectric lens over the entire circumference; and at least an inner surface of the supporting plate is made of metal.

7. A wireless device comprising a dielectric lens antenna comprising a dielectric lens having a rotation-symmetrically shaped body having a perimeter edge portion and at least one flat part disposed at a part only of the perimeter edge portion and further comprising a primary radiator disposed at a focal point of the dielectric lens.

8. A wireless device comprising a dielectric lens antenna comprising a dielectric lens having a rotation-symmetrically shaped body having a perimeter edge portion and a primary radiator disposed at a focal point of the dielectric lens and further comprising a first flat part and a second flat part respectively disposed at a part of the edge portion of the dielectric lens and opposed to each other.

9. A wireless device comprising a dielectric lens antenna comprising a dielectric lens having a rotation-symmetrically shaped body having a perimeter edge portion and at least one flat part disposed at a part only of the perimeter edge portion and further comprising a primary radiator disposed at a focal point of the dielectric lens and further wherein the primary radiator and the dielectric lens are connected by a supporting plate extending in a taper shape from the outer periphery of the primary radiator to the edge portion of the dielectric lens over the entire circumference; and at least an inner surface of the supporting plate is made of metal.

10. A wireless device comprising a dielectric lens antenna comprising a dielectric lens having a rotation-symmetrically shaped body having a perimeter edge portion and wherein a first flat part and a second flat part are respectively disposed at a part of the perimeter edge portion of the dielectric lens and opposed to each other, and further comprising a primary radiator disposed at a focal point of the dielectric lens; and further wherein the primary radiator and the dielectric lens are connected by a supporting plate extending in a taper shape from the outer periphery of the primary radiator to the edge portion of the dielectric lens over the entire circumference; and at least an inner surface of the supporting plate is made of metal.

* * * * *